United States Patent [19]

Quesada

[11] 4,010,183

[45] Mar. 1, 1977

[54] ANHYDROUS SOLVENT SEPARATION IN PRODUCTION OF POLYOL MONOACYLATES

[75] Inventor: Camilo Quesada, Parma Heights, Ohio

[73] Assignee: SCM Corporation, New York, N.Y.

[22] Filed: Mar. 28, 1975

[21] Appl. No.: 563,130

[52] U.S. Cl. ..... 260/428.5; 260/410.6; 260/410.7; 260/410.8; 260/419; 260/485 S; 260/643 A; 260/707

[51] Int. Cl.[2] ..... C11B 7/00

[58] Field of Search ..... 260/428.5, 410.6, 410.7, 260/419, 643 A, 707

[56] References Cited

UNITED STATES PATENTS 3,345,389 10/1967 Zilch ..... 260/419

3,649,657 3/1972 Staker et al. ..... 260/419

FOREIGN PATENTS OR APPLICATIONS 751,920 1/1967 Canada ..... 260/419

674,044 11/1963 Canada ..... 260/643 A

*Primary Examiner*—Helen M. McCarthy

*Attorney, Agent, or Firm*—Jerry K. Mueller, Jr.

[57] ABSTRACT

Crystallizable $C_3$ polyol monoacylates are separated from a mixture thereof with related polyol polyacylates by solvent fractionation of such mixture. The separated $C_3$ polyol monoacylates are melted and subjected to a stripping operation under reduced pressure and anhydrous conditions, with at least the final phase of such stripping being performed with inert gas sparging of the melt.

9 Claims, No Drawings

ANHYDROUS SOLVENT SEPARATION IN PRODUCTION OF POLYOL MONOACYLATES

BACKGROUND OF THE INVENTION

This invention relates to an improved process for separating crystallizable $C_3$ polyol monoacylates from a feed mixture thereof with related polyol polyacylates.

The $C_3$ polyol monoacylates of concern herein are the monoacylates (monoesters) of glycerine and propylene glycol, i.e. monoglycerides and propylene glycol monoesters of $C_{2-26}$ fat-forming acids. Typical such fat-forming acids include the acids: lauric, myristic, palmitic, oleic, stearic, butyric, linoleic, behenic, elaidic, and like fatty acids. Preferably such mono-acylates are edible, advantageously with $C_{8-26}$ acyl groups, and most commonly and preferably with $C_{12-22}$ acyl groups. While the crystallizable mono-acylates most readily and preferably handled in this process are those having reasonably high capillary melting points (eg. at least 100° F. or higher), those lower in melting point also can be separated effectively by the process.

Crystallizable $C_3$ polyol monoacylates form crystals separable from the parent mixture by cooling such mixture, eg. to a temperature below about 50° C. The temperature at which such monoacylates crystallize can be as low as about −40° C. or even lower. It may be advantageous on occasion to employ superatmospheric or subatmospheric pressure during fractional crystallization for special effects, but preferably, for efficiency and economy, atmospheric pressure is used for the fractional crystallization. Fractional crystallization of feed mixture for this process generally is carried out by dissolving the mixture in a solvent, cooling the solution until a crystalline fraction is formed, and separating said crystalline fraction from remaining solution. Often such process is termed "solvent fractionation".

Monoesters of glycerine and propylene glycol (monoglycerides and monoglycolates) have many uses such as emulsifiers, particularly in foods, cosmetics, etc.

Heretofore, various processes have been suggested for separating a fatty mixture into various fractions enriched in one or more of mixture components and depleted in others by fractional crystallization of such mixture. One such process (Canadian Pat. No. 751,920) shows the separation of an $\alpha$-monoglyceride from a mixture of monoglycerides with di- and triglycerides by dissolving such mixture in 2-nitropropane solvent, cooling the solution to form a crystalline fraction, filtering off the crystals (rich in monoglycerides) from the remaining mother liquor, washing such crystals with additional cold 2-nitropropane solvent, and removing residual solvent from the crystals by vacuum distillation or by steam distillation. It should be noted here that distillations tend to degrade concentrated monoglycerides at even modestly elevated distillating temperatures, and steam distillation tends to degrade such monoglycerides even at fairly low distilling temperatures, thus substantially detracting from the concentration effected in the prior fractional crystallization operation.

Another prior proposal (U.S. Pat. No. 2,608,564) suggests the separation of polyhydric alcohol partial ester mixtures into its various components based on degree of saturation of such components by dissolving the mixture in a solvent of alcohol plus monocarboxylic acid, cooling the mixture to form a crystalline fraction, separating the crystals from the remaining mixture, washing the crystals with additional cold solvent, and drying the washed crystals in their solid state.

Still another prior proposal (U.S. Pat. No. 2,450,235) suggests the separation of fatty oil substances into components of such mixture based on degree of saturation of such components by dissolving the mixture in a solvent such as an aliphatic ketone, cooling the mixture to form a crystalline fraction, separating the crystalline fraction from remaining mixture by vacuum filtration, washing the crystalline fraction with additional cold solvent, and passing cold inert gas through the solid crystalline filter cake under vacuum to remove residual wash solvent and to maintain the crystalline fraction in cool solid state.

Yet another prior proposal (U.S. Pat. No. 2,934,547) suggests the separation of glyceride oils into component fractions based on degree of saturation of such fractions by dissolving the oil in a polar solvent, melting the crystalline cake at about 121°, removing solvent therefrom by flash evaporation at 138°–160°, then passing inert gas through the concentrated melt to remove residual amounts of solvent. Still other proposals (U.S. Pat. Nos. 2,684,377 and 2,684,378) separate triglyceride oils such as peanut and cottonseed oils into component fractions based on degree of saturation of such fractions by dissolving the oil in a solvent composed of polar solvent and a normally liquid hydrocarbon (such as hexane), chilling the mixture, removing the crystalline fraction formed from remaining mixture by centrifuging, and heating the removed crystalline fraction to about 100° under reduced pressure of 10 millimeters of mercury with a stream of nitrogen gas being passed therethrough to remove residual amounts of solvent.

Advantages of this invention over prior proposals include the ability to produce a concentrated $C_3$ polyol monoacylate fraction economically and in good purity. Virtually all of the solvent is removed from this product without causing substantial molecular rearrangement or other degradation of the concentrated monoacylate product.

The instant invention is based on several factors not readily apparent from or recognized by the abundant art on fractional crystallization of fatty substances in general, and $C_3$ polyol monoacylates in particular. One factor is that the presence of steam, water, or other hydroxylated solvent in such crystal crop tends to degrade and cause loss of the monoacylate in the crop even at temperatures of 100°–150°, forming free polyol, free fatty acid, polyol diacylates, and polyol triacylates. Correlative with this is the avoidance of otherwise popular steam stripping. Said Canadian patent suggests steam stripping; thus clearly it is unconcerned with the degradation this can bring. The maximum stripping temperature of 150° also is quite critical as a further factor for prevention of the same kind of degradation, even in the absence of hydroxylated solvent.

Thus, the instant process can be characterized in part as providing effective stripping conditions for removal of such free polyol while substantially precluding degradation of the concentrated monoacylate product, a consequence not heretofore taught or probably even recognized in the art of monoglyceride partial crystallization (which even proposed clearly deleterious steam distillation of such product).

SUMMARY OF THE INVENTION

The instant invention is an improvement in process for separating crystallizable $C_3$ polyol monoacylate from a feed mixture thereof with related polyol polyacylates by fractionally crystallizing said monoacylates as a crystal crop from a solution of said feed mixture in a fugitive solvent therefor. It comprises: restricting said solvent to one having no hydroxyl groups; melting said crystal crop; and subjecting the resulting melt to a stripping operation under reduced pressure and anhydrous conditions at a temperature not substantially above about 150° C. until there is virtually no solvent residual in said melt, at least the final phase of said stripping being performed with inert gas sparging of said melt.

DETAILED DESCRIPTION OF THE INVENTION

The feed mixture comprises $C_3$ polyol monoacylates and related polyol polyacylates; it can contain minor amounts of free polyol and free fatty acid, eg. if the feed mixture has been previously steam deodorized. Related polyol polyacylates can include $C_3$ polyol diacylates, $C_3$ polyol triacylates, and acylates of polyol polymers such as minor proportions of polyglycerol acylates. Free polyols include glycerine, propylene glycol, and mixtures thereof. Free fatty acids generally are $C_{2-26}$ fat-forming acids, such acids normally found in glyceride oils and fats, including hydrogenated peanut oil, cottonseed oil, corn oil, soybean oil, safflower oil, lard, tallow, palm kernel oil, sunflower oil, palm oil, so-called "lower molecular" fats, and like glyceride oils. Such mixture can be an equilibrium or non-equilibrium mixture of the components therein. The feed mixture can be previously steam deodorized or not for use in the instant invention. Conventinal steam deodorization by contacting the monoacylate with steam causes rearrangement of the acylate portion of the monoacylate, thus it lowers the concentration of available monoacylate for recovery from the feed. The instant invention separates $C_3$ polyol monoacylates from the mixture without causing appreciably more of such rearrangement. Previously steam deodorized feed mixtures, therefore, can be employed in the instant process to separate a rich $C_3$ polyol monoacylate fraction from such steam deodorized feed mixture.

Conventional "superglycolation" of fat with propylene glycol can produce a mixture containing esters of glycerine and propylene glycol. Fractional crystallization of such mixture in accordance with the precepts of the instant invention will cause monoesters of glycerine to crystallize more completely than the monoesters of propylene glycol, although practically such a result is often difficult to measure and confirm. Similarly, fractional crystallization of a mixture containing $\alpha$- and $\beta$-monoglycerides tends to concentrate in the crystal crop the $\beta$-(hydroxy) form slightly relative to the $\alpha$-(hydroxy) form. Probably $\beta$-(hydroxy) form monoacylates of propylene glycol also tend to so concentrate relative to $\alpha$-(hydroxy) form of monoacylates of propylene glycol.

Conventional "superglycerination" of fat with glycerine can produce a mixture containing partial glycerides for the feed here. Conventional esterification of a $C_3$ polyol with free fatty acid, also can produce a mixture containing the $C_3$ polyol acylates for the feed here, ie. one containing partial glycerides or monoesters of propylene glycol, or a mixture of such partial glycerides and such monoesters of propylene glycol if the $C_3$ polyol is a mixture of glycerine and propylene glycol. In addition to forming the $C_3$ monoacylate-providing feed stock (mixture) by such direct esterification or glycerolysis and/or glycolysis, the feed stock also can be made by the reaction of fatty acid halide (such as a chloride) with the $C_3$ polyol or polyol mixture to form the acylate mixture and by-product hydrogen halide.

TABLE 1

| | | |
|---|---|---|
| (1) | Triglyceride fat + glycerine → | Monoglycerides + diglycerides + triglycerides |
| (2) | Triglyceride fat + propylene glycol → | Monoglycerides + diglycerides + triglycerides + esters of propylene + diesters of propylene glycol |
| (3) | Free fatty acid+ glycerine → | Monoglycerides + diglycerides + triglycerides |
| (4) | Free fatty acid + propylene glycol → | Monoesters of propylene glycol + diesters of propylene glycol |
| (5) | Fatty acid halide + glycerine → | Monoglycerides + diglycerides + triglycerides |
| (6) | Fatty acid halide + propylene glycol → | Monoesters of propylene glycol + diesters of propylene glycol |

The feed stock so produced can be deodorized conventionally, eg. by steam deodorization (often under vacuum), or such feed stock can be used in the instant process without such deodorization.

Prime sources for the mixture include glycerolysis or glycolysis of fats, particularly those fats having capillary melting point of 80° to 160° F., using about 19 to 40 parts of the polyol or polyol mixture per 100 parts of triglyceride fat.

The appropriate solvent suitable for use in the instant fractionation process is solvent having no hydroxyl groups. The solvent should be fugitive for separation from the monoacylate product, i.e., have a normal boiling point at 1 atmosphere total pressure of not substantially above about 250° C., advantageously about 200° C., and preferably about 150° C. For purposes of this application, such solvent is one lacking the capability of donating strong hydrogen bonds (often referred to as aprotic). Suitable such solvents having no hydroxyl groups include nitropropanes and preferably 2-nitropropane, acetone, 2-butanone, acetamide, tetrahydrofuran, dimethylsulfone, carbon tetrachloride, hexane, dimethylacetamide, hexamethylphosphoramide, chloroform, N-methyl pyrrolidone, benzene, dimethylformamide and like solvents wherein the solubility of the crystallizable $C_3$ polyol polyacylates, in terms of weight thereof per weight of solvent at a particular temperature generally decreases in this order: $C_3$ polyol triacylates, $C_3$ polyol diacylates, and $C_3$ polyol monoacylates with the glycerol monoacylates coming out largely before the corresponding glycol monoacylates, that is glycol monoacylates having the same kind of acyl groups as the monoglycerides. Thus their broad crystallization order, as the temperature of a solution of such mixture of polyol polyacylates in the solvent is lowered, occurs broadly in the reverse of said solubility order.

In practicing this invention, the first step is to form a solution of the feed mixture with non-hydroxylated solvent at a temperature at which such mixture dissolves in the solvent to form a substantially clear solution to the naked eye. Preferably, the temperature should be only high enough to form such solution, such temperature generally being below the boiling point of the solvent at the operating pressure, which pressure preferably is atmospheric. The weight ratio of solvent to feed mixture depends upon the solubility of the particular feed mixture in the solvent at elected temperatures and pressure for dissolving the feed and for cropping the monoacylates therefrom (preferably atmospheric pressure, dissolving at about 40°–70°, and cropping at about 0°–40°). Advantageously, the weight ratio of the solvent to the feed mixture will be between about 2:1 and about 10:1 for efficiency and economy, although ratios above 10:1 can be suitably employed in the instant process. The higher the weight ratio of solvent to feed mixture is, the sharper this fractionation can be and the purer the monoacylate fraction can be at the expense of handling more solution.

The solution then is cooled until a crystalline magma rich in monoacylate crystals is formed. The temperature at which the crystalline magma is formed depends upon the particular feed mixture and solvent being cooled. Such cooling preferably is done at a rate of about 1° to 5° per minute for obtaining filterable crystals efficiently. Seeding, eg. with crystalline polyol monoacylate such as that to be produced, often is desirable. Lipoidal material other than the monoacylates tends to remain in the cooled solution. Such other lipoidal material includes $C_3$ polyol diacylates, and $C_3$ polyol triacylates.

The crystallized monoacylates then are cropped from the cooled solution. Such cropping can be by conventional filtration or centrifuging. Advantageously, the filtered crop is washed with additional solvent used to form the mixture. Often it is of advantage to use a lighter, lower-boiling nonhydroxylated solvent to wash the crystalline monoacylates. Such lighter solvent is removed more readily in the later stripping operation, but obviously complicates solvent recovery procedures.

The washed crop is melted and subjected to stripping operation to remove residual solvent. Such stripping advantageously is performed under reduced total pressure of about 540–740 millimeters of mercury. In any event the stripping temperature should not be substantially in excess of about 150° C. Above about 150° substantial molecular rearrangement can occur in the monoacylate. The stripping also is performed under anhydrous conditions because the presence of water will cause such molecular rearrangement and consequent degradation of the monoacylate product even at temperatures below 150°. At least the final phase of the stripping is performed with inert gas sparging. The stripping operation removes virtually all of the solvent from the melt.

The cropping of desired monoacylates can be done to get one large crop, or a succession of two or even more crops by lowering the temperature for each crop appropriately. Such additional crops can be washed and stripped as above outlined. The crystalline monoacylates obtained generally will have a total monoacylate content of from about 60 to about 95 percent by weight.

Simultaneously with the monoacylate separation from the mixture, some degree of separation of the monoacylates based on degree of saturation occurs, as can be seen from the examples of this application. Usually, however, in order to further separate initially-cropped monoacylates into various fractions based on their degree of saturation, only further dissolution in and fractional crystallization of such initially-cropped monoacylates fraction from solvent is practical. By subjecting the initially separated monoacylates to additional fractional crystallization techniques one or more fractions of various iodine values can be separated therefrom.

By a careful selection of the temperature at which the magma is cropped, the monoacylate concentration in the crop separated from the feed mixture can be controlled. Generally, the crystalline monoacylates separated from a given feed mixture will have a lower concentration of monoacylates when a lower temperature of crystallization is used, as can be seen from the examples herein.

The following examples show how the instant invention can be practiced, but should not be construed as limiting the invention. In the specification, all parts are parts by weight, all percentages are weight percentages, and all temperatures are in degrees Centigrade unless otherwise expressly indicated.

EXAMPLE 1

The feed mixture was commercially available Durem 114 food emulsifier (Durem is a trademark of SCM Corporation). This emulsifier had been prepared by the glycerolysis of a hydrogenated (83–861V) soybean oil (which had been conventionally steam deodorized) using 19–20 parts of glycerine per 100 parts of oil with sodium hydroxide catalyst at 232°. The product was neutralized and free glycerine in the emulsifier was reduced to 3% or less by evaporation under reduced pressure to yield a feed mixture as specified in Table 2 below.

Three hundred fifty parts of this feed mixture were dissolved in 2,100 parts of 2-nitropropane (6:1 weight ratio of solvent to feed mixture) at 54°. The solution was cooled gradually to 16.1° over a 25-minute period with gentle agitation, whereupon a crystalline magma formed. The crystals, rich in monoglycerides, were separated from the solution by filtration, washed with 352 parts of additional (wash) 2-nitropropane solvent at 16.1°, and the crop was pressed. The wash solvent was added to the filtrate and this liquor was cooled to minus 6.67°, at which temperature a second crystalline magma formed. A second crystal crop was separated by filtration, washed, and pressed in a manner similar to that above described for the first crystal crop. The two crystal crops were melted separately. Each of these melts and the second filtrate plus second wash solvent each were stripped separately to a content of approximately 1% (or less) solvent under 540 mm. mercury total pressure at about 75° until no further distillate was observed to come over, followed by stripping of the residue at 740 mm. mercury at about 125°, again until no further distillate was observed coming over. Dry nitrogen then was passed through each residue at 125° under a partial vacuum of 700 mm. mercury for ½ hour to remove virtually all of the 2-nitropropane solvent.

Table 2 displays analytical data of the initial mixture and final separated fractions obtained, and the fractionation conditions as above given.

TABLE 2

| | Feed Mixture (wt. %) | First Crop | Second Crop | Residue |
|---|---|---|---|---|
| Crystallization Temperature, ° | — | 16.1 | −6.67 | — |
| Fraction (wt. % of Original Feed Mixture) | — | 16.0 | 22.7 | 61.1 |
| Monoglyceride Content (wt. %) | 44.6 | 90.4 | 62.5 | 25.5 |
| Fatty Acid Analysis | | | | |
| Carbon Number: | Number of double bonds | | | |
| 8:0 | 0.3 | trace | 0.1 | 0.4 |
| 10:0 | 0.2 | trace | 0.1 | 0.2 |
| 12:0 | 1.5 | 1.2 | 1.6 | 1.5 |
| 14:0 | 0.7 | 1.0 | 0.8 | 0.6 |
| 16:0 | 11.4 | 25.6 | 14.7 | 6.8 |
| 16:1 | 0.2 | — | 0.1 | 0.3 |
| 17:0 | 0.1 | 0.4 | 0.2 | 0.1 |
| 18:0 | 5.2 | 14.5 | 7.9 | 2.4 |
| 18:1 | 63.9 | 49.3 | 65.3 | 65.8 |
| 18:2 | 14.9 | 4.9 | 7.2 | 20.1 |
| 18:3 | 0.9 | 0.2 | 0.7 | 1.2 |
| 20:0 | 0.3 | 0.9 | 0.6 | 0.3 |
| 22:0 | 0.2 | 0.7 | 0.3 | trace |
| Conjugated Dienes | 0.2 | 0.3 | 0.4 | 0.3 |
| Iodine Value (Calculated) | 83.6 | 51.9 | 62.5 | 95.3 |

The total monoglyceride content displayed in Table 2 was determined by gas-liquid chromatography. As can be seen from these results, the first separated monoglyceride fraction had a monoglyceride content of 90.4%, or almost double the monoglyceride content of the initial feed mixture; and the second monoglyceride fraction had a monoglyceride concentration of 62.5%, or approximately 40% higher than monoglyceride content of the initial feed mixture. The stripped residue from the filtrates can be recycled into admixture with a second charge of soybean oil for glycerolysis with glycerine for preparation of a feed mixture suitable for a subsequent run like that of this Example.

EXAMPLE 2

The feed mixture was prepared by the glycerolysis of refined Malaysian palm oil (which had been previously steam deodorized at 240° for 1 hour under a partial vacuum of one mm. mercury) using 651 parts of glycerine and 2,966 parts of the deodorized palm oil with 2.2 parts of sodium hydroxide catalyst. Said ingredients were heated from room temperature to 231° in one hour 35 minutes, followed by the addition of 6.6 parts of phosphoric acid for neutralization of excess catalyst and soaps formed during such glycerolysis. The feed mixture then was steam deodorized under a total pressure of 0.5 mm. mercury for one hour 15 minutes from an initial temperature of 96° to a final temperature of 150°. The steam deodorized feed mixture contained 45.3% by weight monoglycerides and had an iodine value of 50.8.

Three separate batches (300 parts each of such mixture) each were dissolved in 2,100 parts of 2-nitropropane (7:1 ratio of solvent to mixture) at 54°. Crystalline magmas formed upon cooling of the mixtures to 24.44°, 23.33°, and 19.44°, respectively. A crop was separated from each batch at the particular batch temperature. Separation, washing, and stripping of each crop was performed in a manner like that of Example 1, except only 300 parts of wash solvent was used to wash the separated crystals. Table 3 summarizes the results.

TABLE 3

| | Crystallization Temperature, ° | Monoacylate Crop (wt. % of Feed Mixture) | Monoglyceride Content (wt. %) | Iodine Value |
|---|---|---|---|---|
| Feed Mixture | — | — | 45.3 | 50.8 |
| Crop of Batch 1 | 24.44 | 17.6 | 87.3 | 4.2 |
| Crop of Batch 2 | 23.33 | 19.1 | 82.2 | 3.9 |
| Crop of Batch 3 | 19.44 | 22.9 | 76.4 | 3.8 |

These results demonstrate that the concentration of monoglycerides separated can be controlled by selecting the temperature at which the magma is crystallized and cropped. The concentration of monoglycerides separated in each batch is substantially higher than that of the initial feed mixture. Furthermore, highly saturated monoglyceride fractions (4.2; 3.9; and 3.8 I.V., respectively) were separated from the relatively unsaturated initial mixture (50.8 I.V.). The crop of Batch 2 was tested and found to have a Capillary Melting Point of 68.22° and free glycerol content of 0.9% by weight.

EXAMPLE 3

Three different feed mixtures were prepared from three different fat sources. The first feed mixture was commercially available DUREM 207 food emulsifier which had been prepared by glycerolysis of a 0.0–3.0 I.V. cottonseed stearine in the manner outlined in Example 1, except that 20–30 parts of glycerine per 100 parts of cottonseed stearine was used in the glycerolysis. The second feed mixture was prepared by glycerolysis of a 60:40 blend of soybean stearine (0.0–3.0 I.V.) and liquid soybean oil (130–135 I.V.). The third feed mixture was prepared by glycerolysis of an 8–12 I.V. fraction of refined Malaysian palm oil. All three fat sources were steam deodorized prior to preparation of the feed mixture by glycerolysis of each such fat.

Each such feed mixture of glycerolyzed fat was dissolved in 2-nitropropane solvent, cooled, and cropped as indicated in Table 4. Each crop was washed and stripped in a manner similar to that of Example 1. Two substantially identical batches were run using the first feed mixture (glycerolyzed cottonseed stearine), except that two different solvent-to-feed mixture ratios were used. The second feed mixture (soybean stearine-soybean oil blend) was cooled and cropped, then further cooled and cropped again. Two substantially identical batches were run using the third feed mixture (Malaysian palm oil).

TABLE 4

| | Solvent:Feed Mixture Weight Ratio | Crystallization Temperature, ° | Fraction (Wt. % of Initial Feed Mixture) | Monoglyceride Content (Wt. %) | Iodine Value |
|---|---|---|---|---|---|
| Cottonseed Stearine | | | | | |
| Feed Mixture | — | — | — | 50.0 – 55.0 | 0.0 – 3.0 |
| Crop of 1st Batch | 6:1 | 40.56 | 41.5 | 71.5 | |
| Crop of 2nd Batch | 7:1 | 40.00 | 36.5 | 81.2 | |
| Soybean Stearine: Soybean Oil (60:40 wt. ratio) | | | | | |
| Feed Mixture | — | — | — | 52.9 | 50.0 – 55.0 |
| First Crop | 7:1 | 32.22 | 31.1 | 76.5 | 1.6 |
| Second Crop | — | −1.11 | 27.8 | 38.1 | |
| Liquid Palm Oil (Top Fraction) | | | | | |
| Feed Mixture | — | — | — | 46.3 | 8.0 – 12.0 |
| Crop of 1st Batch | 7:1 | 32.22 | 33.3 | 72.9 | 0.7 |
| Crop of 2nd Batch | 7:1 | 34.72 | 20.1 | 92.8 | 0.8 |

The monoglyceride content of each product from the cottonseed stearine mixture was substantially higher than that of the original feed mixture. The addition of more solvent to the mixture of the second batch here appeared to have some effect as to increasing the monoglyceride content of the separated fraction relative to the monoglyceride content obtained in the first batch using less solvent.

The monoglyceride content of the first crop from the soybean stearine-soybean oil mixture was substantially higher than that of the initial feed mixture. The monoglyceride content of the second crop was lower than that of the initial feed mixture because it was taken at such a low temperature.

Two different crystallization temperatures were used in the two Malaysian palm oil batches. Consistent with the results obtained in Example 2, a lower monoglyceride content of the crop taken at the lower temperature was obtained. The monoglyceride content of each product still was substantially higher than that of the original feed mixture. The crop of the second batch from the Malaysian palm oil was found to have a Capillary Melting Point of 65.22° and free glycerol content of 0.5% by weight.

I claim:

1. In a process for separating crystallizable $C_3$ polyol monoacylates having $C_{2-26}$ acyl groups from a feed mixture thereof with related polyol polyacylates by fractionally crystallizing said monoacylate as a crystal crop from a solution of said feed mixture in fugitive aprotic solvent therefor, the improvement for substantially precluding degradation of said cropped monoacylate which comprises:

a. restricting said solvent to one having no hydroxyl groups;

b. melting said crystal crop; and c. subjecting the resulting melt to a stripping operation under reduced pressure and anhydrous conditions at a temperature not substantially above about 150° C. until there is virtually no solvent residual in said melt, at least the final phase of said stripping being performed with inert gas sparging of said melt.

2. The process of claim 1 wherein said $C_3$ polyol monoacylates are monoglycerides.

3. The process of claim 1 wherein said $C_3$ polyol monoacylates are propylene glycol monoacylates.

4. The process of claim 1 wherein said solvent is 2-nitropropane.

5. The process of claim 1 wherein said inert gas is nitrogen.

6. The process of claim 1 wherein said feed mixture comprises glycerides of hydrogenated soybean oil which are dissolved in 2-nitropropane solvent at a weight ratio of about 1:6, said stripping operation being performed at less than atmospheric pressure at less than 150° C. with the final stage being sparging of said melt with nitrogen gas at less than atmospheric pressure at less than 150° C.

7. The process of claim 1 wherein said feed mixture comprises glycerides of palmoil which are dissolved in 2-nitropropane solvent at a weight ratio of about 1:7, said stripping operation being performed at less than atmospheric pressure at less than 150° C. with the final stage being sparging of said melt with nitrogen gas at less than atmospheric pressure at less than 150° C.

8. The process of claim 1 wherein said feed mixture comprises glycerides of cottonseed stearin which are dissolved in 2-nitropropane solvent at a weight ratio of about 1:6–1:7, said stripping operation being performed at less than atmospheric pressure at less than 150° C. with the final stage being sparging of said melt with nitrogen gas at less than atmospheric pressure at less than 150° C.

9. The process of claim 1 wherein said feed mixture comprises glycerides of liquid soybean/soybean stearin which are dissolved in 2-nitropropane solvent at a weight ratio of about 1:7, said stripping operation being performed at less than atmospheric pressure at less than 150° C. with the final stage being sparging of said melt with nitrogen gas at less than atmospheric pressure at less than 150° C.

* * * * *